US008914281B2

(12) United States Patent
Yoon et al.

(10) Patent No.: US 8,914,281 B2
(45) Date of Patent: Dec. 16, 2014

(54) METHOD AND APPARATUS FOR PROCESSING AUDIO SIGNAL IN A MOBILE COMMUNICATION TERMINAL

(75) Inventors: Gun-Hyun Yoon, Gyeonggi-do (KR); Dong-Won Lee, Gyeonggi-do (KR); Ju-Hee Chang, Gyeonggi-do (KR); Koong-Hoon Nam, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 169 days.

(21) Appl. No.: 13/252,470

(22) Filed: Oct. 4, 2011

(65) Prior Publication Data

US 2012/0084083 A1 Apr. 5, 2012

(30) Foreign Application Priority Data

Oct. 4, 2010 (KR) ..... 10-2010-0096212

(51) Int. Cl.
*G10L 21/00* (2013.01)
*G10L 21/028* (2013.01)
*G10L 21/0208* (2013.01)

(52) U.S. Cl.
CPC ..... *G10L 21/028* (2013.01); *G10L 21/0208* (2013.01)
USPC ..... 704/226; 704/227; 704/228

(58) Field of Classification Search
CPC ..... G10L 2021/02; G10L 2021/0208; G10L 2021/02165; G10L 2021/0316; G10L 2021/0364; G10L 21/02; G10L 21/003; G10L 21/028; G10L 21/034; G10L 21/0205; G10L 21/0208; G10L 21/0272; G10L 21/0232; G10L 21/0316; G10L 21/0324; G10L 21/0364
USPC ..... 704/200.1, 201, 205, 225–228
See application file for complete search history.

(56) References Cited

U.S. PATENT DOCUMENTS

| | | | | |
|---|---|---|---|---|
| 5,722,086 | A * | 2/1998 | Teitler et al. | 455/561 |
| 7,050,966 | B2 * | 5/2006 | Schneider et al. | 704/200.1 |
| 7,454,010 | B1 * | 11/2008 | Ebenezer | 379/392.01 |
| 7,630,887 | B2 * | 12/2009 | Erell | 704/225 |
| 7,668,714 | B1 * | 2/2010 | Croak et al. | 704/228 |
| 7,693,708 | B2 * | 4/2010 | Gournay et al. | 704/201 |
| 7,773,759 | B2 * | 8/2010 | Alves et al. | 381/71.1 |
| 2008/0228473 | A1 * | 9/2008 | Kinoshita | 704/225 |
| 2009/0248409 | A1 * | 10/2009 | Endo et al. | 704/226 |

(Continued)

FOREIGN PATENT DOCUMENTS

| | | | | |
|---|---|---|---|---|
| WO | WO 96/42142 | * | 12/1996 | |
| WO | WO 2010071521 | A1 * | 6/2010 | G10L 21/02 |

OTHER PUBLICATIONS

Kinoshita, Sachie, et al.; Patent Application Publication No. US2008/0228473 A1; Publication Date: Sep. 18, 2008; "Method and Apparatus for Adjusting Hearing . . . ;".

*Primary Examiner* — Douglas Godbold
(74) *Attorney, Agent, or Firm* — Cha & Reiter, LLC

(57) ABSTRACT

A method and an apparatus for processing an audio signal in a mobile terminal, in which an audio signal that is received from a counterpart mobile terminal is classified into a voice signal and a noise signal according to respective energy. A frequency of the classified voice signal and an energy of the classified noise signal is controlled according to a predetermined criteria, then the controlled voice signal and the controlled noise signal are coupled and output to a speaker.

6 Claims, 5 Drawing Sheets

(56) References Cited

U.S. PATENT DOCUMENTS

2010/0057449 A1* 3/2010 Lee et al. ..... 704/225
2010/0121635 A1* 5/2010 Erell ..... 704/225
2011/0099007 A1* 4/2011 Zhang ..... 704/211
2013/0218560 A1* 8/2013 Hsiao et al. ..... 704/233

* cited by examiner

<NOISE IMPROVES>

<VOICE IMPROVES>

<BOTH NOISE AND VOICE IMPROVE>

METHOD AND APPARATUS FOR PROCESSING AUDIO SIGNAL IN A MOBILE COMMUNICATION TERMINAL

CLAIM OF PRIORITY

This application claims the benefit under 35 U.S.C. §119 of a Korean patent application filed in the Korean Intellectual Property Office on Oct. 4, 2010 and assigned Serial No. 10-2010-0096212, the entire disclosure of which is hereby incorporated by reference.

BACKGROUND OF THE INVENTION

1. Field of the Invention

The present invention relates to a mobile terminal. More particularly, the present invention relates to a method and an apparatus for processing an incoming audio signal received in a mobile terminal.

2. Description of the Related Art

Generally, when mobile terminals exchanges voice or video communication, various noises caused by a user's neighboring environment is input to a microphone of the mobile terminal, then processed together with the user's voice. As a result, when the counterpart mobile terminal reproduces a voice signal, the user's voice may be distorted or may not be properly heard.

Therefore, the conventional mobile terminal removes a noise processed together with a voice signal using an auto gain controller or an audio compressor. For example, the conventional art removes a noise signal included in an audio signal through a method of determining a section where a voice signal exists, and a section where the voice signal does not exist and only a noise signal exists according to an energy of the received audio signal, and then increasing an output gain of the section where the voice signal exists and reducing an output gain of the section where the noise signal exists.

However, since the conventional methods remove all signals of the noise section from the audio signal, a user experiences a phenomenon where communication is disconnected during the noise section, thus causing inconveniences to the user.

Therefore, a method for processing an audio signal so that a user may accurately listen to a counterpart user's voice while the user does not feel the phenomenon during communication in a mobile terminal needs to be provided.

SUMMARY OF THE INVENTION

An aspect of the present invention is to address at least the above-mentioned problems and/or disadvantages and to provide at least the advantages described below. Accordingly, an aspect of the present invention is to provide a method and an apparatus for processing an audio signal in a mobile terminal.

Another aspect of the present invention is to provide a method and an apparatus for providing a comfort noise to a receiver side user when reproducing an audio signal during communication in a mobile terminal.

Still another aspect of the present invention is to provide a method and an apparatus for classifying an audio signal received during communication in a mobile terminal into a voice signal and a noise signal.

Yet another aspect of the present invention is to provide a method and an apparatus for analyzing a characteristic of a noise signal input via a microphone to remove a voice and a noise of an audio signal received from a counterpart mobile terminal during communication in a mobile terminal.

A further aspect of the present invention is to provide a method and an apparatus for providing comfort noise to a receiving side user according to noises caused by the user's neighboring environment during a communication mode in a mobile terminal.

In accordance with an aspect of the present invention, a method for processing an audio signal in a mobile terminal includes: classifying an audio signal received from a counterpart mobile terminal into a voice signal and a noise signal according to an energy size, controlling a frequency of the classified voice signal, controlling an energy size of the classified noise signal, and coupling the controlled voice signal and the controlled noise signal to output the same to a speaker.

In accordance with another aspect of the present invention, an apparatus for processing an audio signal in a mobile terminal includes: a detector for classifying an audio signal received from a counterpart mobile terminal into a voice signal and a noise signal according to an energy size, an equalizer for controlling a frequency of the classified voice signal, a noise gain controller for controlling an energy size of the classified noise signal, and a digital-to-analog converter for coupling the controlled voice signal and the controlled noise signal to output the same to a speaker.

Other exemplary aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

Throughout the drawings, like reference numerals will be understood to refer to like parts, components and structures.

DETAILED DESCRIPTION OF THE INVENTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Exemplary embodiments of the present invention provide a method and an apparatus for processing an audio signal received from a counterpart mobile terminal during communication in a mobile terminal.

Hereinafter, for convenience in description, a mobile terminal that processes an audio signal is denoted by a receiver side terminal, and a counterpart mobile terminal in communication with the mobile terminal is denoted by a transmitter side terminal.

Figure 1:
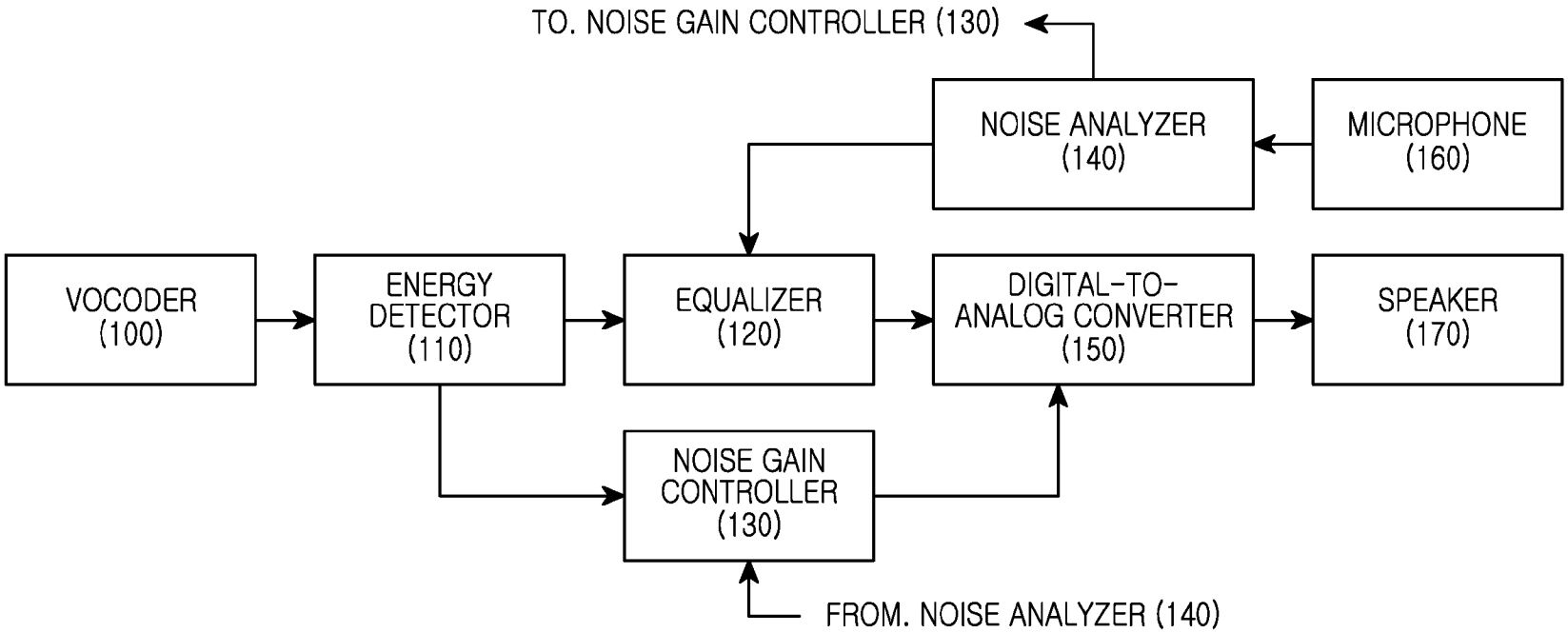
FIG. 1 is a block diagram for processing an audio signal in a mobile terminal according to an exemplary embodiment of the present invention.

FIG. 1 is a block diagram for processing an audio signal in a mobile terminal according to an exemplary embodiment of the present invention. Here, the mobile terminal is a receiver side terminal, and includes a vocoder 100, an energy detector 110, an equalizer 120, a noise gain controller 130, a noise analyzer 140, a digital-to-analog converter 150, a microphone 160, and a speaker 170.

Referring to FIG. 1, the vocoder 100 decodes an audio signal received from a counterpart mobile terminal, i.e., a transmitter side terminal via a communication module (not shown) and provides the same to the energy detector 110.

The energy detector 110 determines an energy of the audio signal received from the transmitter side terminal, and classifies the audio signal of the transmitter side terminal into a voice signal and a noise signal based on the determined energy. The energy detector 110 provides the classified voice signal to the equalizer 120, and provides the classified noise signal to the noise gain controller 130.

The equalizer 120 controls a frequency of the voice signal of a transmitter side terminal according to an energy of each frequency of a noise signal at a receiver side terminal end. That is, the equalizer 120 receives frequency information of a noise signal of the receiver side terminal from the noise analyzer 140, maintains or changes a frequency of the voice signal of the transmitter side terminal provided from the energy detector 110 according to the frequency information of the noise signal of the receiver side terminal, i.e., noise frequency of receiver side noise signal, and then provides the outcome to the digital-to-analog converter 150. For example, the equalizer 120 controls the frequency of the voice signal such that the frequency of the voice signal of the transmitter side terminal provided from the energy detector 110 does not overlap the noise frequency of the receiver side. More particularly, the frequency of the voice signal from the energy detector 110 may be controlled to a frequency that does not overlap the noise frequency of the receiver side within an audible frequency.

The noise gain controller 130 controls an energy of a transmitter side noise signal according to an energy of the receiver side noise signal. That is, the noise gain controller 130 receives information regarding an energy of the receiver side noise signal from the noise analyzer 140, maintains or changes an energy of a noise signal provided from the energy detector 110 according to the energy of the receiver side noise signal, and provides the same to the digital-to-analog converter 150. Here, the noise gain controller 130 may control the energy of the noise signal provided from the energy detector 110 with reference to a table or a function representing an energy relation of a transmitter side noise signal that depends on an energy of a receiver side noise signal. The table or a look up table would have different energy of the noise signal from the transmitter side that would correspond to the energy from the receiver side by a predetermined factor. Thus, the noise gain controller 130 determines an energy of a transmitter side noise signal corresponding to an energy of a receiver side noise signal provided from the noise analyzer 140 in a table of a noise signal set in advance, and controls by adjusting the energy of a transmitter side noise signal provided from the energy detector 110 by the determined energy.

The noise analyzer 140 analyzes a characteristic of a receiver side noise signal and provides the same to the equalizer 120 and the noise gain controller 130. That is, the noise analyzer 140 analyzes a signal input via the microphone 160 to measure an energy of a noise signal, compares an energy for each frequency with a threshold to determine whether a frequency having an energy greater than the threshold exists, and obtains frequency information having an energy of the noise signal greater than the threshold. The noise analyzer 140 provides an energy for the measured receiver side noise signal to the noise gain controller 130, and provides frequency information for the receiver side noise signal to the equalizer 120. Here, the threshold may be set in advance, and may be set with consideration of at least one of an energy of a noise signal and an energy of a voice signal input via the microphone 160.

The digital-to-analog converter 150 couples a voice signal provided from the equalizer 120 and a noise signal provided from the noise gain controller 130, and converts the coupled digital signal into an analog signal to provide the same to the speaker 170.

The microphone 160 receives a voice signal of a receiver and a noise signal that depends on a situation in the neighborhood of the receiver to provide the same to the noise analyzer 140.

The speaker 170 outputs an analog signal provided from the digital-to-analog converter 150.

Figure 2:
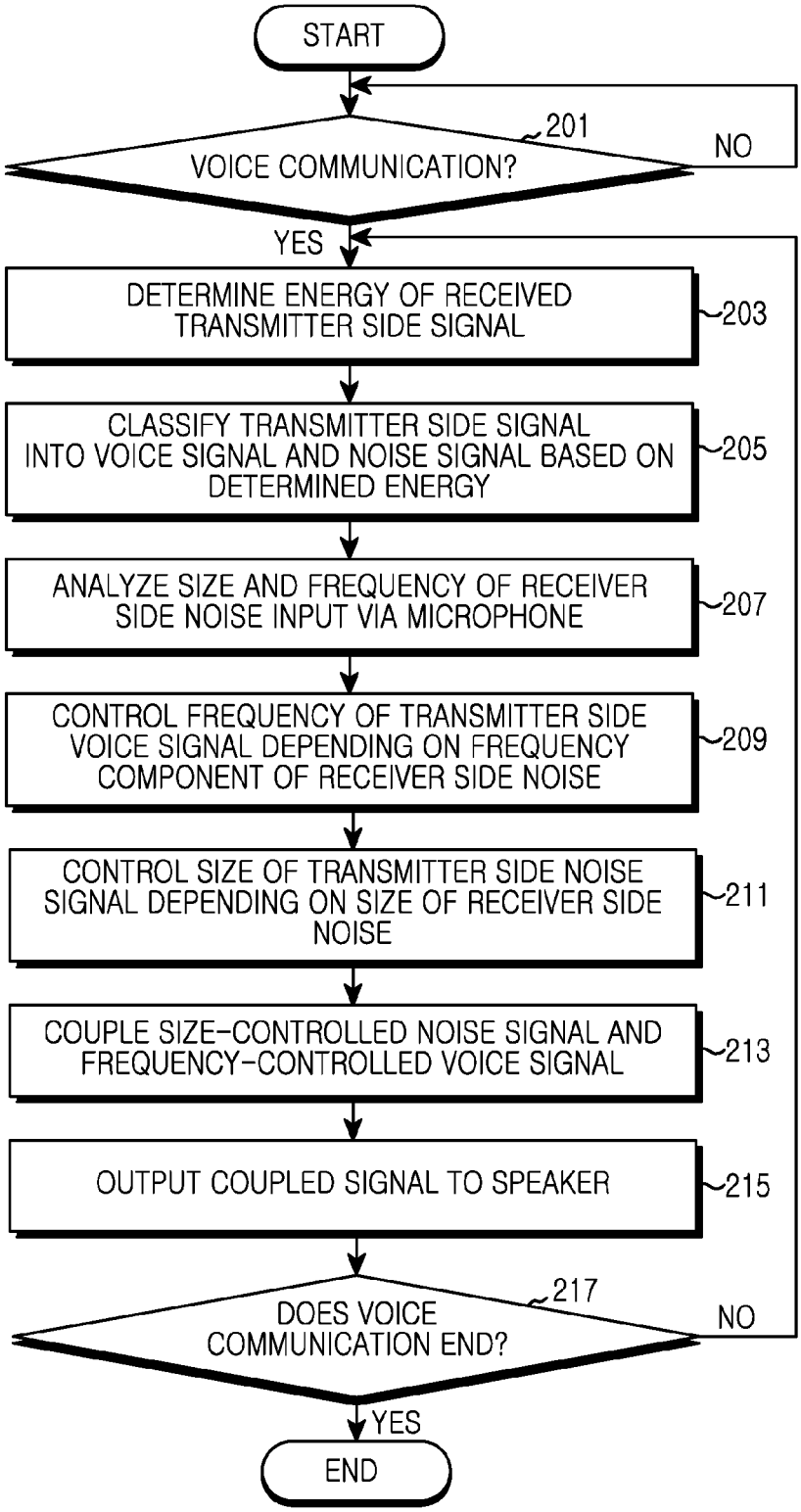
FIG. 2 is a flowchart illustrating a process for processing an audio signal in a mobile terminal according to an exemplary embodiment of the present invention.

FIG. 2 is a flowchart illustrating a process for processing an audio signal in a mobile terminal according to an exemplary embodiment of the present invention. Here, the mobile terminal denotes a receiver side terminal. In addition, though voice communication is exemplarily described in the following, exemplary embodiments are applicable to an audio signal transmitted/received during video communication.

Referring to FIG. 2, when voice communication occurs in step 201, the receiver side terminal determines an energy of an audio signal received from a counterpart mobile terminal, i.e., a transmitter side terminal in step 203, and classifies the audio signal received from the transmitter side terminal into a voice signal and a noise signal based on the determined energy in step 205.

The receiver side terminal analyzes a receiver side audio signal input via a microphone 160 of the receiver side terminal to determine an energy of a noise signal, and compares an energy for each frequency of the noise signal with a threshold to obtain information regarding a frequency having an energy size greater than the threshold, i.e., a noise frequency in step 207.

The receiver side terminal controls a frequency of the classified voice signal according to the receiver side noise frequency in step 209. That is, the receiver side terminal maintains or changes a frequency of the classified voice signal from the transmitter side terminal according to a noise frequency of the receiver side noise signal through an equalizer 120. For example, the equalizer 120 controls the frequency of the voice signal such that the frequency of the classified voice signal of the transmitter side terminal does not overlap the noise frequency within an audible frequency.

The receiver side terminal controls an energy of the classified noise signal according to an energy of the receiver side noise signal in step 211. Here, the receiver side terminal may control an energy of the classified noise signal with reference to a table or a function representing an energy relation of a transmitter side noise signal that depends on an energy of a receiver side noise signal. For example, the noise gain controller 130 determines an appropriate energy of a transmitter side noise signal corresponding to an energy of the receiver side noise signal from a predetermined look up table having a noise signal set in advance, and then adjusts the energy of the classified noise signal according to the determined energy from the look up table to compensate the noise level of the received signal from the transmitter side.

The receiver side terminal couples a voice signal whose frequency has been controlled through the equalizer 120 and a noise signal whose energy has been controlled through the noise gain controller 130 in step 213, and outputs the coupled signal via a speaker in step 215.

The receiver side terminal determines whether voice communication ends in step 217. When the voice communication does not end, the receiver side terminal returns to step 203 to re-perform subsequent steps. In contrast, when the voice communication ends, the receiver side terminal ends the algorithm according to an exemplary embodiment of the present invention.

Figure 3A:
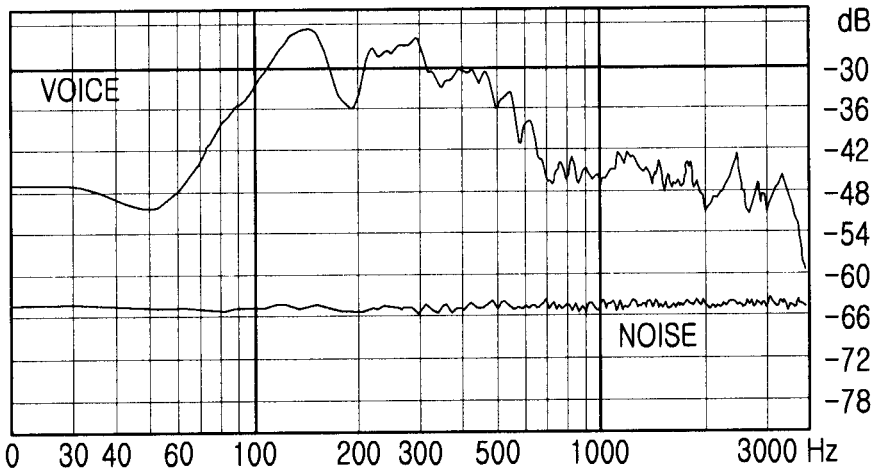
FIG.3A (PRIOR ART)
FIGS. 3A to 3C are views illustrating graphs illustrating results of processing an audio signal according to the conventional art and an exemplary embodiment of the present invention.
Figure 3B:
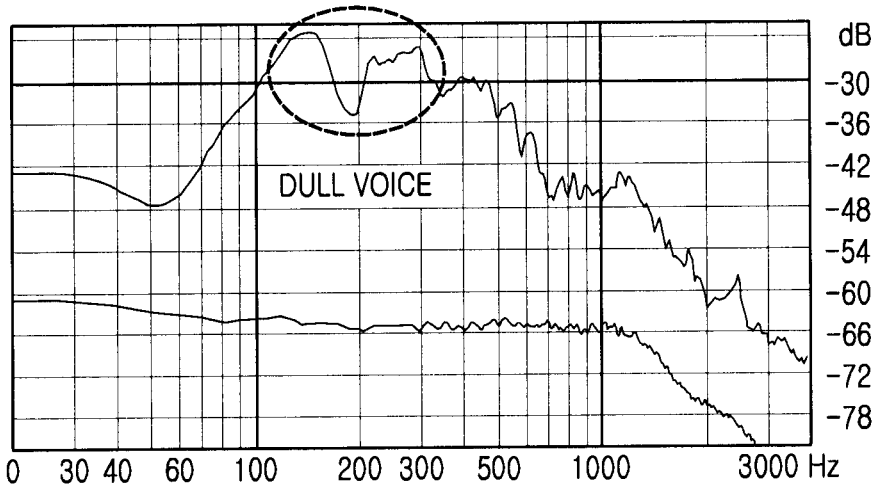
FIG.3B (PRIOR ART)
Figure 3B:
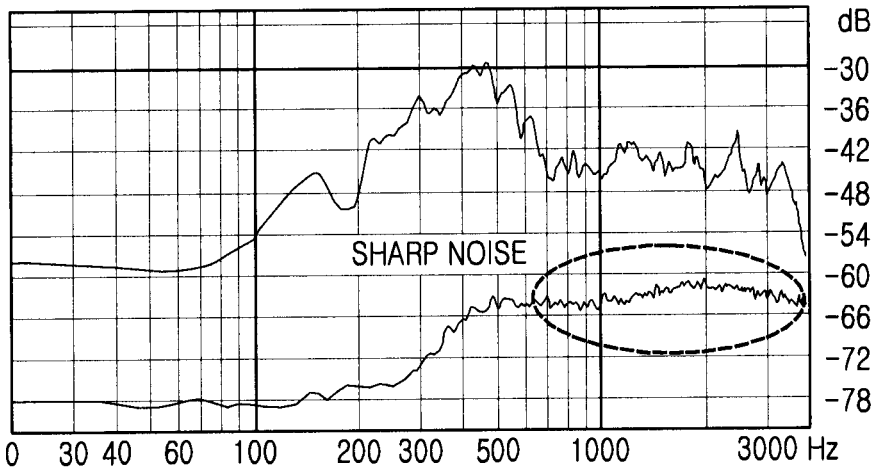
FIG.3B (PRIOR ART)
Figure 3C:
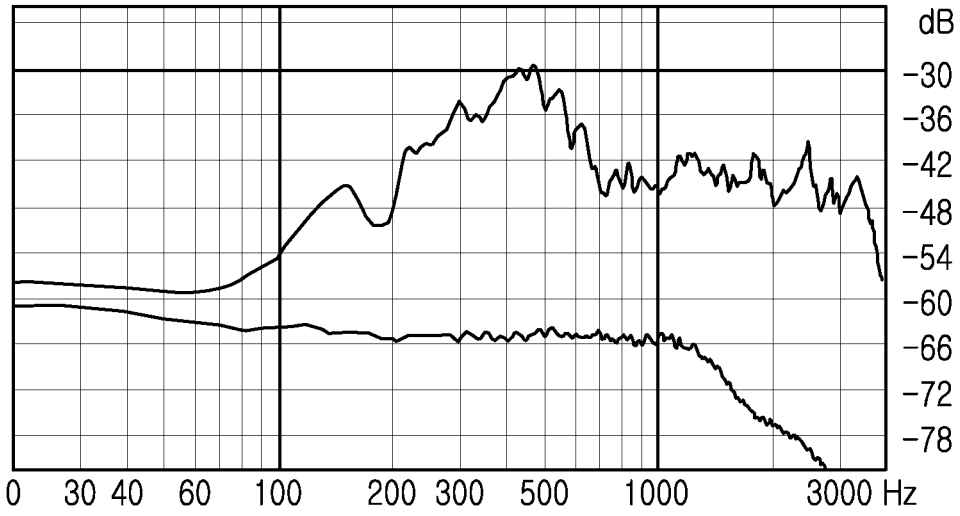

FIGS. 3A to 3C are views illustrating graphs illustrating results of processing an audio signal according to the conventional art and an exemplary embodiment of the present invention. Here, a horizontal axis represents a frequency, and a vertical axis represents an energy of a signal.

FIG. 3A illustrates an audio signal received from a transmitter side terminal in a receiver side terminal, FIG. 3B illustrates results of processing an audio signal of a transmitter side as in FIG. 3A in a receiver side terminal according to the conventional art, and FIG. 3C illustrates results of processing an audio signal of a transmitter side as in FIG. 3A in a receiver side terminal according to an exemplary embodiment of the present invention. Here, referring to FIG. 3B, in case of processing an audio signal of a transmitter side according to the conventional art where it merely increases an output gain where the voice signal exists and reduces an output gain where the noise signal exists, since the audio signal is not classified into a voice signal and a noise signal for processing, the voice signal is reduced when a noise is removed, and the noise signal becomes sharp when the voice signal is improved.

In contrast, referring to FIG. 3C, in case of processing an audio signal of a transmitter side according to an exemplary embodiment of the present invention, since the audio signal is classified into a voice signal and a noise signal and processing is performed with consideration of a noise signal of a receiver side, both the noise and the voice are improved.

Exemplary embodiments of the present invention clearly improve a voice signal by classifying an audio signal received from a counterpart mobile terminal into the voice signal and a noise signal during communication in a mobile terminal, and then analyzing a characteristic of a noise signal input via a microphone to control the classified voice signal and noise signal, and provide a noise of a proper level that provides a comfort to a user of the mobile terminal, thereby providing a comfortable communication environment.

The above-described methods according to the present invention can be implemented in hardware, firmware or as software or computer code that can be stored in a recording medium such as a CD ROM, an RAM, a floppy disk, a hard disk, or a magneto-optical disk or downloaded over a network and stored on a non-transitory machine readable medium, so that the methods described herein can be rendered in such software using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

Although the invention has been shown and described with reference to certain exemplary embodiments thereof, it will be understood by those skilled in the art that various changes in form and details may be made therein without departing from the spirit and scope of the invention as defined by the appended claims and their equivalents. Therefore, the scope of the present invention should not be limited to the above-described embodiments but should be determined by not only the appended claims but also the equivalents thereof.

What is claimed is:

1. A method for processing an audio signal in a mobile terminal, the method comprising:

classifying prior to processing an audio signal received from a counterpart mobile terminal into a voice signal and a noise signal according to a respective energy level for consideration of the noise signal when processing is performed, the noise being environmental noise;

analyzing a frequency and energy level of a noise signal received from a microphone of the mobile terminal;

controlling through an equalizer a frequency of the classified voice signal to maintain or change the frequency of the classified voice signal so that the frequency of the classified voice signal does not overlap with the frequency of the noise signal within an audible frequency received from the microphone;

controlling by a noise gain controller a size of the energy level of the classified noise signal according m a size of the energy level of the noise signal received from the microphone, the size of the energy level being controlled with reference to a table representing a relation between the size of the energy level of the noise signal from the mobile terminal and the size of the energy level of the classified noise signal; and coupling the frequency-controlled voice signal and the size-controlled noise signal to output the coupled frequency-controlled voice signal and the size-controlled noise signal to a speaker of the mobile terminal.

2. The method of claim 1, wherein the controlling of the frequency of the classified voice signal comprises:

comparing an energy for each frequency of the noise signal received from the microphone with a threshold;

obtaining a frequency of a noise signal having an energy great than the threshold.

3. A mobile terminal, comprising:

a detector for classifying prior to processing ml audio signal received from a counterpart mobile terminal into a voice signal and a noise signal according to an energy for consideration of the noise signal when processing is performed, the noise being environmental noise;

a noise analyzer for analyzing a frequency and energy level of a noise signal received from a microphone of the mobile terminal;

an equalizer for controlling a frequency of the classified voice signal to maintain or change the frequency of the classified voice signal so as not m overlap with the frequency of noise signal received from the microphone:

a noise gain controller for controlling a size of the energy level of the classified noise signal according to a size of the energy level of the noise signal received from the microphone, the size of the energy level being controlled with reference to a table representing a relation between the size of the energy level of the noise signal from the mobile terminal and the size of the energy level of the classified noise signal; and a digital-to-analog converter for coupling the controlled voice signal and the size-controlled noise signal to output the same to a speaker.

4. The mobile terminal of claim 3, wherein the analyzer compares an energy level for each frequency of the noise signal input from the microphone with a threshold to obtain a frequency of a noise signal having an energy level greater than the threshold.

5. The mobile terminal of claim 4, wherein the equalizer controls the frequency of the classified voice signal within an audible frequency.

6. The mobile terminal of claim 3, wherein the noise gain controller controls the size of the energy level of the classified noise signal according to the size of the energy level of the noise signal analyzed by the noise analyzer.

* * * * *

UNITED STATES PATENT AND TRADEMARK OFFICE

CERTIFICATE OF CORRECTION

PATENT NO. : 8,914,281 B2
APPLICATION NO. : 13/252470
DATED : December 16, 2014
INVENTOR(S) : Gun-Hyuk Yoon et al.

It is certified that error appears in the above-identified patent and that said Letters Patent is hereby corrected as shown below:

On the Title Page

Item 75, 1st inventor should read as follows:
--...Gun-Hyuk Yoon...--

In the Claims

Column 6, Claim 1, Line 38 should read as follows:
--...according to a size...--

Column 6, Claim 2, Line 54 should read as follows:
--...greater than the threshold...--

Column 6, Claim 3, Line 56 should read as follows:
--...to processing an audio...--

Column 6, Claim 3, Line 66 should read as follows:
--...as not to overlap...--

Signed and Sealed this
Thirty-first Day of March, 2015

Michelle K. Lee

Michelle K. Lee
*Director of the United States Patent and Trademark Office*